US008337997B2

(12) United States Patent
Sugahara et al.

(10) Patent No.: US 8,337,997 B2
(45) Date of Patent: Dec. 25, 2012

(54) COMPOSITE MATERIAL FOR ELECTRICAL/ELECTRONIC PART AND ELECTRICAL/ELECTRONIC PART USING THE SAME

(75) Inventors: Chikahito Sugahara, Tokyo (JP); Satoru Zama, Tokyo (JP); Akira Tachibana, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/977,167

(22) Filed: Dec. 23, 2010

(65) Prior Publication Data

US 2011/0091740 A1 Apr. 21, 2011

Related U.S. Application Data

(63) Continuation of application No. PCT/JP2009/061429, filed on Jun. 23, 2009.

(30) Foreign Application Priority Data

Jun. 24, 2008 (JP) ..... 2008-164850

(51) Int. Cl.

| | |
|---|---|
| ***B32B 15/088*** | (2006.01) |
| ***B32B 15/20*** | (2006.01) |
| ***C23C 30/00*** | (2006.01) |
| ***C25D 5/50*** | (2006.01) |

(52) U.S. Cl. ..... 428/626; 428/610; 428/675; 148/537; 148/518; 427/383.7; 427/123; 205/228

(58) Field of Classification Search ..... None
See application file for complete search history.

(56) References Cited

U.S. PATENT DOCUMENTS

| | | | | |
|---|---|---|---|---|
| 4,019,877 | A * | 4/1977 | Gass et al. | 428/626 |
| 4,720,401 | A * | 1/1988 | Ho et al. | 427/250 |
| 5,246,564 | A * | 9/1993 | Tamiya et al. | 205/169 |
| 5,916,695 | A | 6/1999 | Fister et al. | |
| 2009/0291318 | A1* | 11/2009 | Sugahara et al. | 428/603 |
| 2010/0092680 | A1* | 4/2010 | Ohga et al. | 427/383.1 |

FOREIGN PATENT DOCUMENTS

| | | | |
|---|---|---|---|
| JP | 64-80056 | A | 3/1989 |
| JP | 5-1367 | A | 1/1993 |
| JP | 2000-113731 | A | 4/2000 |
| JP | 2002-237542 | A | 8/2002 |
| JP | 2004-197224 | A | 7/2004 |
| JP | 2006-86513 | A | 3/2006 |

OTHER PUBLICATIONS

Machine Translation of Published Japanese Application JP 2004-197224 to Tani et al., Jul. 15, 2004.*

(Continued)

*Primary Examiner* — John J Zimmerman
(74) *Attorney, Agent, or Firm* — Birch, Stewart, Kolasch & Birch, LLP

(57) ABSTRACT

A composite material for an electrical/electronic part, which is used as a material for use in an electrical/electronic part, containing: a metal base material having at least a surface formed of Cu or a Cu alloy; and an insulating film provided on at least a part of the metal base material; wherein a metal layer having Cu diffused in Ni or a Ni alloy is interposed between the metal base material and the insulating film; and wherein the ratio of the number of Cu atoms to the number of Ni atoms (Cu/Ni) obtained by analyzing the outermost surface of the metal layer by Auger electron spectroscopy is 0.005 or more.

5 Claims, 1 Drawing Sheet

OTHER PUBLICATIONS

Machine Translation of Published Japanese Application JP 05-001367 to Kurita et al., Jan. 8, 1993.*

International Search Report dated Aug. 11, 2009 in International Application No. PCT/JP2009/061429.

Extended European search report in European Application No. 09770166.8 mailed Jun. 29, 2011.

* cited by examiner

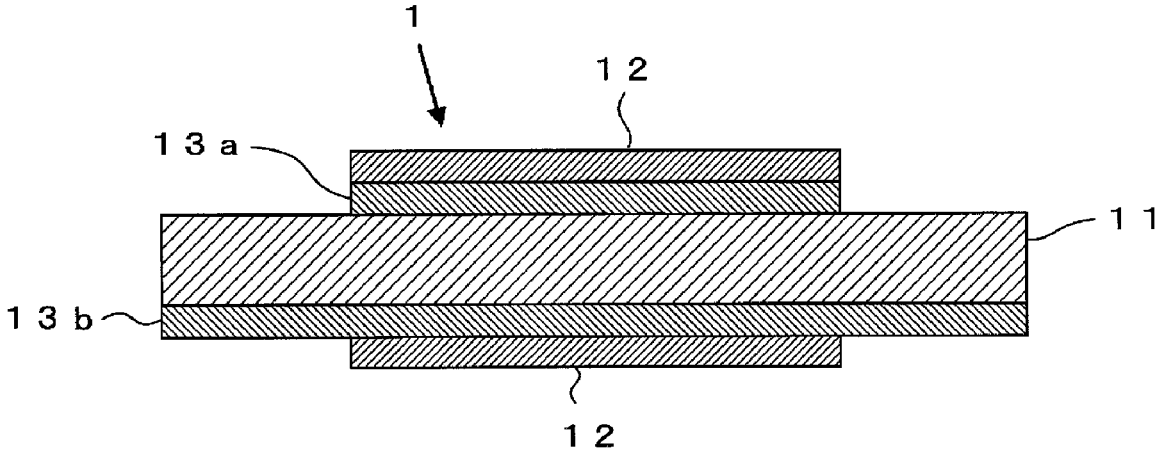
1
12
13a
11
13b
12

COMPOSITE MATERIAL FOR ELECTRICAL/ELECTRONIC PART AND ELECTRICAL/ELECTRONIC PART USING THE SAME

CROSS REFERENCE TO RELATED APPLICATIONS

This application is a Continuation of PCT International Application No. PCT/JP2009/061429 filed on Jun. 23, 2009, which claims the benefit of Patent Application No. 2008-164850 filed in Japan, on Jun. 24, 2008. The entire contents of all of the above applications is hereby incorporated by reference into the present application.

TECHNICAL FIELD

The present invention relates to a composite material for an electrical/electronic part having an insulating film on a metal base material, and an electrical/electronic part using the same.

BACKGROUND ART

A metal material provided with an electric insulating film on a metal base material (also referred to simply as an insulating film in the present invention) is utilized in, for example, a circuit board as a shielding material (see, for example, Patent Literatures 1 and 2). The metal material is suitable for a container, a case, a cover, a cap and the like, especially for a low height device container case (a height of an internal space is lowered).

When the metal material provided with the insulating film on the metal base material is applied as a material for the electrical/electronic part, since the insulating film is provided on the metal base material, it is possible to arrange connector contacts with a narrow pitch through machining such as punching at a spot including an interface between the metal base material and the insulating film to form the connector contacts. Accordingly, the material may be applicable to various applications.

Patent Literature 1: JP-A-2002-237542 ("JP-A" means unexamined published Japanese patent application)

Patent Literature 2: JP-A-2004-197224

DISCLOSURE OF INVENTION

Technical Problem

Patent Literature 2 describes a composite material for an electrical/electronic part having an insulating film provided on a metal base material, through at least one metal layer. By selecting Ni or a Ni alloy for the metal layer, an effect of enhancing the heat resistance or corrosion resistance of the metal base material or enhancing the adhesiveness of the insulating film is expected. However, when the actual applicability of the electrical/electronic part is considered, there may be some inconveniences.

When applying the composite material for an electrical/electronic part to electrical/electronic part such as cases or connectors is considered, the composite material is in many cases subjected to a post-plating treatment with Sn, Ni, Ag, Au or the like, in consideration of solderability, corrosion resistance of the punched surface, or reliability as for electrical contacts. In such circumstances, if a metal layer formed of Ni or a Ni alloy is provided at a site where the insulating film is not provided, since the surface of the metal layer is covered with a passive film of Ni and is therefore inert, the adhesiveness of the plating later provided deteriorates, thereby causing a problem that the plating is peeled off at the worst.

In order to avoid this problem, it may be considered to provide a method of providing the interposed metal layer only at a site immediately below the insulating film, or to carry out a special pretreatment for removing the passive film of Ni as a pretreatment for the post-plating treatment. However, upon considering that all of these measures require large technical efforts and capital investment expenditure, these measures are not so economically efficient. Furthermore, even in the case where the interposed metal layer is provided only at a site immediately below the insulating film, when punching processing has been carried out at certain sites including the insulating film, the interposed metal layer is surely exposed at the perforated cross-section. Therefore, the same problem occurs.

Furthermore, many electrical/electronic parts are formed into predetermined shapes by punching processing or bending processing, and then are mounted by soldering. In this case as well, if a metal layer formed of Ni or a Ni alloy is provided at sites where the insulating film is not provided, the passive film of Ni causes deterioration of solderability, and there occur problems such as inconvenience in mounting.

An object of the present invention is to provide a composite material for an electrical/electronic part having excellent post-plating properties or solderability and having a metal layer formed of Ni or a Ni alloy interposed at the interface between a metal base material and an insulating film, and to provide an electrical/electronic part formed of this composite material for an electrical/electronic part.

Solution to Problem

The inventors of the present invention conducted a thorough investigation on the problems described above. As a result, the inventors found that when Cu is exposed to the surface of a metal layer formed of Ni or a Ni alloy and is interposed between a metal base material and an insulating film, sufficient adhesiveness of plating in a post-plating treatment or sufficient solderability may be obtained. Thus, the inventors conducted further investigations and finally completed the present invention.

According to the present invention, there is provided the following means:

(1) A composite material for an electrical/electronic part, which is used as a material for use in an electrical/electronic part, comprising:

a metal base material having at least a surface formed of copper (Cu) or a copper alloy; and an insulating film provided on at least a part of the metal base material;

wherein a metal layer having Cu diffused in Ni or a Ni alloy is interposed between the metal base material and the insulating film; and wherein the ratio of the number of Cu atoms to the number of Ni atoms (Cu/Ni) obtained by analyzing the outermost surface of the metal layer by Auger electron spectroscopy is 0.005 or more.

(2) The composite material for an electrical/electronic part described in the above item (1), wherein the insulating film is composed of a polyimide or a polyamide-imide.

(3) The composite material for an electrical/electronic part described in the above item (1) or (2), wherein the metal layer is a layer having Cu thermally diffused at the surface.

(4) An electrical/electronic part, comprising the composite material for an electrical/electronic part described in any one of the above items (1) to (3), which is formed by subjecting at least a part of the metal layer to a plating treatment.

(5) An electrical/electronic part, comprising the composite material for an electrical/electronic part described in any one of the above items (1) to (3), which is formed by subjecting at least a part of the metal layer to a soldering treatment.

(6) A method of producing a composite material for an electrical/electronic part, comprising the steps of:

forming an insulating film on a metal base material having at least a surface formed of Cu or a Cu alloy, through a metal layer formed of Ni or a Ni alloy at least partially interposed between the metal base material and the insulating film;

performing a heat treatment before or after forming the insulating film to thermally diffuse Cu at the surface of the metal layer, thereby adjust the ratio of the number of Cu atoms to the number of Ni atoms (Cu/Ni) obtained by analyzing the outermost surface of the metal layer by Auger electron spectroscopy to 0.005 or more.

Advantageous Effects of Invention

According to the present invention, since Cu is exposed to the surface of the metal layer interposed between a metal base material and an insulating film such that the ratio of the number of Cu atoms to the number of Ni atoms (Cu/Ni) obtained by analyzing the outermost surface of the metal layer formed of Ni or a Ni alloy by Auger electron spectroscopy, is 0.005 or more, a composite material for an electrical/electronic part which exhibits excellent adhesiveness of plating or excellent solderability when formed into an electrical/electronic part, can be obtained.

Furthermore, according to the present invention, a composite material for an electrical/electronic part which exhibits excellent adhesiveness of plating or excellent solderability when formed into an electrical/electronic part, can be more easily obtained by using the following constitutions in combination.

(1) The insulating film is composed of a polyimide or a polyamide-imide.

(2) The composite material is subjected to a heat treatment before or after forming the insulating film.

Furthermore, since the electrical/electronic part of the present invention has Cu exposed at the surface of the metal layer, an electrical/electronic part having excellent adhesiveness of plating to a site where an insulating film that includes at least a part of a metal layer is not provided, can be easily obtained.

Moreover, since the electrical/electronic part of the present invention has Cu exposed at the surface of the metal layer, an electrical/electronic part having excellent solderability to a site where the insulating film that includes at least a part of the metal layer is not provided, can be easily obtained.

Other and further features and advantages of the invention will appear more fully from the following description, appropriately referring to the accompanying drawing.

BRIEF DESCRIPTION OF THE DRAWINGS

FIG. 1 is a section view showing one exemplary composite material for an electrical/electronic part according to a preferred embodiment of the present invention.

REFERENCE NUMERALS

| | |
|---|---|
| 1 | Composite material for an electrical/electronic part |
| 11 | Metal base material |
| 12 | Insulating film |
| 13 | Metal layer |
| 13a | Metal layer on upper surface side |
| 13b | Metal layer on lower surface side |

BEST MODE FOR CARRYING OUT THE INVENTION

Preferred embodiments of the present invention will be explained.

FIG. 1 shows a cross-section of a composite material for an electrical/electronic part according to a preferred embodiment of the invention. As shown in FIG. 1, this composite material for an electrical/electronic part 1 has an insulating film 12 provided on a metal base material 11; and has a metal layer 13 having Cu diffused in Ni or a Ni alloy, provided between the metal base material 11 and the insulating film 12. This metal layer 13 is composed of a metal layer on the upper surface side 13*a* and a metal layer on the lower surface side 13*b*, with respect to the metal base material 11. Since Cu is exposed at the surfaces of the metal layers 13*a* and 13*b* such that the ratio of the number of Cu atoms to the number of Ni atoms (Cu/Ni) obtained by analyzing the outermost surfaces by Auger electron spectroscopy, is 0.005 or more, a composite material for an electrical/electronic part 1 having excellent adhesiveness of plating or excellent solderability to a site where the insulating film that includes at least a part of the metal layer is not provided, can be realized. Here, the value of the ratio of the number of Cu atoms to the number of Ni atoms (Cu/Ni) is preferably 1 or less. When this value exceeds 1, oxidation of Cu proceeds, and there is a risk that the solderability to the metal layer surface may decrease.

In the present invention, the composite material may have the boundary between the metal base material 11 and the metal layer 13*a* or 13*b* disappeared due to the process of diffusing Cu in the metal layers 13*a* and 13*b*, and have the metal base material and the metal layers integrated. Even in this case, the outermost surface that is analyzed by Auger electron spectroscopy is indicated as the "outermost surface of the metal layer".

FIG. 1 shows an example in which the insulating films 12 are provided on the entire outer surface of the metal layer 13*a* on the upper surface side and on a part of the outer surface of the metal layer 13*b* on the lower surface side. However, this is merely an example, and the insulating film 12 may be provided on the entire outer surface of the metal layer 13*a* on the upper surface side, on the entire outer surface of the metal layer 13*b* on the lower surface side, on a part of the outer surface of the metal layer 13*a* on the upper surface side, on a part of the outer surface of the metal layer 13*b* on the lower surface side, or on a region extending over both of the metal base material 11 and the metal layer 13*a* or 13*b*. That is, the insulating film 12 may be provided on at least a part of the metal layer 13*a* or 13*b*. Hereinafter, the metal layer 13 will be explained by combining the metal layers 13*a* and 13*b*.

The metal layer 13 is provided, for example, for the protection of the surface of the metal base material 11, or for an enhancement of the adhesiveness of the insulating film 12. The metal layer 13 is desirably a layer obtained by forming a metal layer formed of N or a Ni alloy by a method such as electroplating or chemical plating, on a metal base material 11 having at least the surface formed of Cu or a Cu alloy, and then thermally diffusing Cu at the surface. In the case of forming a metal layer formed of Ni or a Ni alloy by plating, the plating may be carried out by wet plating or dry plating. Examples of the wet plating include an electroplating method and an electroless plating method. Examples of the dry plating include a physical vapor deposition (PVD) method and a chemical vapor deposition (CVD) method.

The thickness of the metal layer 13 is desirably less than 0.1 μm, and more desirably 0.001 to 0.05 μm. If the metal layer is excessively thick, the exposure of Cu to the surface of the metal layer does not occur, and the adhesiveness of plating or the solderability to a site where the insulating film that includes at least a part of the metal layer is not provided, becomes poor. Furthermore, if the metal layer is excessively thick, when the composite material is subjected to fabrication such as punching processing or bending processing, shear droop is enlarged, or cracks occur, so that there is a risk that peeling of the insulating film may be promoted. Therefore, even from this point of view, it is preferable to adjust the thickness of the metal layer 13 to less than 0.1 μm.

In order to accelerate the exposure of Cu to the surface of the metal layer 13, it is preferable to carry out a heat treatment after the metal layer formed of Ni or a Ni alloy is provided. When the heat treatment is carried out, the diffusion of Cu within the metal layer is promoted, and the amount of exposure of Cu to the surface of the metal layer is increased. The heat treatment may be carried out any time before or after the insulating film 12 is provided. Furthermore, the heat treatment that is carried out when the insulating film 12 is provided, also promotes the diffusion of Cu within the metal layer.

Regarding the conditions of the heat treatment, a heat treatment at 150° C. to 400° C. for 5 seconds to 2 hours is preferred, and a heat treatment at 200° C. to 350° C. for 1 minute to 1 hour is more preferred.

The amount of exposure of Cu to the surface of the metal layer 13 is such that the ratio of the number of Cu atoms to the number of Ni atoms (Cu/Ni) obtained by analyzing the surface of the metal layer by Auger electron spectroscopy, is desirably 0.005 or more, and more desirably 0.03 or more. If the amount of exposure of Cu is small, the adhesiveness of post-plating or the solderability is deteriorated because of the passive film of Ni.

In the present invention, the analysis by Auger electron spectroscopy is carried out such that a direct analysis is carried out on a site where an insulating film is not provided at the surface of the metal layer. When the surface of the metal layer is entirely covered by an insulating film, the insulating film is peeled off by a method such as an immersion treatment in a 40% aqueous solution of potassium hydroxide at 90° C. for 30 minutes, and then the exposed metal layer surface is subjected to the analysis. The method of peeling the insulating film is not limited to the method described above, and as long as there is no risk of the ratio of atom number at the surface of the metal layer being changed, the peeling method may be a treatment with an organic solvent or may be a physical peeling treatment.

In the present invention, the ratio of the number of Cu atoms to the number of Ni atoms (Cu/Ni) obtained by analyzing the surface of the metal layer by Auger electron spectroscopy, is a value obtained by making measurement at an accelerating voltage of 10 kV and a current value of 1 nA, on an area having a size of 50 μm×50 μm.

It is desirable that the insulating film 12 has appropriate insulating properties, and when the possibility for the composite material to be reflow mounted after being formed into an electrical/electronic part is considered, it is desirable that the insulating film is formed of a heat resistant resin such as a polyimide or a polyamide-imide. Among them, in particular, when the raw material cost or the balance between productivity and processability such as punching process is considered, a polyamide-imide is desirable.

While it is preferable to use an organic material such as the aforementioned heat resistant resins as the material of the insulating film 12, the material of the insulating film 12 may be appropriately selected corresponding to required characteristics and others of the composite material for an electrical/electronic part 1. For instance, the base material of the organic material such as the heat resistant resin added with an additive (either organic or nonorganic material may be used) other than the base material and a non-organic material may be adopted.

A method of providing the insulating film 12 on the surface of the metal base material 11 through the intermediary of the metal layer 13 includes such methods of (a) placing an adhesive-backed heat-resistant resin film at a part of the metal base material requiring insulation, of melting the adhesive by an induction heating roll and of then implementing a heat treatment to reactively harden and bond them; and (b) applying a varnish prepared by dissolving a resin or a resin precursor in a solvent at a part of the metal base material requiring insulation, and then heating the assembly, with or without having the solvent evaporated as necessary, to thereby induce reactive curing and bonding. It is preferable to use the method (b) described above for the composite material for an electrical/electronic part 1 of the embodiment of the present invention because it is not necessary to consider the influences of the adhesive.

It is noted that a concrete example of the method (b) described above is a general technology in a method for manufacturing insulated electric cables and is known also in JP-A-5-130759. The present invention refers to this gazette as a reference technology.

Here, it is possible to repeat the method (b). It permits to reduce a possibility of insufficient evaporation of the solvent, and to reduce a possibility of generating bubbles between the insulating film 12 and the metal layer 13, so that the adhesion between the insulating film 12 and the metal layer 13 may be enhanced further. This method permits to provide substantially one layer of insulating film 12 on the metal layer 13 in the case where the hardened resins formed separately in a plurality of times are substantially the same material.

Still more, when the insulating film 12 is to be provided on the part of the surface of the metal base material 11, it is possible to adopt a manufacturing method that corresponds to a resin film forming accuracy level of the applied part such as a method of applying a roll coating facility for an offset (planographic) printing or a gravure (intaglio) printing, of applying coating of a photosensitive heat-resistant resin, pattern-forming by means of ultraviolet rays or electron beams and a resin hardening technology; or of applying a micropattern forming technology applying etching and dissolution by an exposure phenomenon on a circuit board. This method is carried our after the metal layer 13 is provided on the surface of the metal base material 11. Those methods make it easily possible to provide the insulating film 12 only on a necessary part(s) of the surface of the metal base material 11 and it becomes unnecessary to remove the insulating film 12 to connect the metal base material 11 with other electric and electronic parts or electric cables.

A thickness of the insulating film 12 is preferable to be from 2 to 20 μm and more preferably from 3 to 10 μm, because it is unable to expect an insulating effect if the thickness is too thin and it becomes difficult to punch if the thickness is too thick.

The metal base material 11 is a metal base material having at least the surface formed of Cu or a Cu alloy. From the viewpoint of electrical conductivity, platability, solderability and the like, it is desirable to use a copper-based metal material for the metal base material 11. Beside copper-based alloys such as phosphor bronze (Cu—Sn—P-series), brass (Cu—Zn-series), nickel silver (Cu—Ni—Zn-series) and Corson alloy (Cu—Ni—Si-series), oxygen-free copper, tough pitch copper, phosphorous-deoxidized copper and others are also applicable as the copper material.

A thickness of the metal base material 11 is preferable to be 0.06 mm or more because enough strength as the electrical/electronic part cannot be assured if the thickness is thinner than 0.06 mm. Still more, the thickness is preferably 0.4 mm or less, more preferably 0.3 mm or less, because an absolute value of a clearance increases in punching and a shear droop of the punched part increases if the thickness is too large. Thus, an upper limit of the thickness of the metal base material 11 is decided by taking the influences (such as the clearance and the size of the shear droop) of machining such as punching into consideration.

Furthermore, the composite material for an electrical/electronic part 1 may be processed by punching processing or the like, and then may be subjected to a plating treatment at a site where the insulating film 12 that includes at least a part of the metal layer 13 is not provided. The site where the insulating film 12 that includes at least a part of the metal layer 13 is not provided, means, for example, the lateral sides of the metal base material 11 including the metal layer 13 shown in FIG. 1, a site other than the part of the upper surface of the metal layer 13 that is provided with the insulating film 12, and the like. The plating treatment used herein can be carried out by using any conventionally used plating, and examples include Ni plating, Sn plating and Au plating. By providing a post-applied metal layer by plating, the surface of the metal base material 11 can be protected.

When a post-applied plating treatment is applied to a metal material provided with an insulating film having a thick metal layer 13, since the surface of the metal layer is covered with a passive film of Ni and is inert, the adhesiveness of the post-applied plating is decreased, and there is a risk that the plating may be peeled off in the worst case. However, because the composite material for an electrical/electronic part 1 in this embodiment has a metal layer 13 with a small thickness and has Cu exposed to the surface of the metal layer, it is advantageous in that the post-applied metal layer is not peeled off even if a post-applied metal layer (not depicted) is provided by post-processing such as plating.

Here, the thickness of the post-applied metal layer is appropriately determined regardless of the thickness of the metal layer 13. When the purpose of protecting the surface of the metal base material 11 is considered, the thickness of the post-applied metal layer is desirably in the range of 0.001 μm to 5 μm. Still more, while a metal used for the post-applied metal layer may be appropriately selected depending on uses of the electrical/electronic part, it is preferable to be Au, Ag, Cu, Ni, Pd or Sn, or an alloy containing them when the electrical/electronic part is used as an electrical contact, a connector or the like.

Furthermore, the composite material for an electrical/electronic part 1 may be processed by punching processing or the like, and then may be subjected to a soldering treatment at a site where the insulating film 12 that includes at least a part of the metal layer 13 is not provided.

The soldering treatment can be carried out by using any conventional treatment method that is commonly used upon forming an electrical/electronic part. When a soldering treatment is applied to a metal material provided with an insulating film having a thick metal layer 13, since the surface of the metal layer is covered with a passive film of Ni and is inert, there is a risk that the solder wettability may be decreased and bonding failure may occur. However, because the composite material for an electrical/electronic part 1 in this embodiment has a metal layer 13 with a small thickness and has Cu exposed to the surface of the metal layer, it is advantageous in that when a soldering treatment is carried out, bonding failure does not occur.

According to another embodiment of the present invention, there is provided an electrical/electronic part using the composite material for an electrical/electronic part 1, which is formed by carrying out the plating treatment described above at a site where the insulating film 12 that includes at least a part of the metal layer 13 is not provided.

According to another embodiment of the present invention, there is provided an electrical/electronic part using the composite material for an electrical/electronic part 1, which is formed by carrying out the soldering treatment described above at a site where the insulating film 12 that includes at least a part of the metal layer 13 is not provided.

Such an electrical/electronic part of the present invention are not limited specifically and include, for example, a connector, a terminal and a shield case, which can be suitably adopted in electric/electronic devices such as a portable phone, a portable information terminal, a notebook computer, a digital camera, and a digital video.

EXAMPLES

The present invention will be described in more detail based on examples given below, but the invention is not meant to be limited by these.

Example 1

(Samples)

The electrolytic degreasing and acid pickling treatments were carried out in this order on metal strips (metal base material) having a thickness of 0.1 mm and a width of 20 mm, and then Ni plating was carried out to provide insulating coating layers having a width of 10 mm at part 5 mm from each strip end, thereby manufacture composite materials for the electrical/electronic parts of this invention and comparative examples. The metal strip used was JIS alloy C5210R (phosphor bronze, manufactured by the Furukawa Electric Co., Ltd.).

(Various Conditions)

The electrolytic degreasing treatment was carried out by implementing cathode-electrolysis on the metal strip for 30 seconds under conditions of 60° C. of liquid temperature and 2.5 A/dm$^2$ of current density within a degreasing solution containing 60 g/L of cleaner 160S (manufactured by Meltex Inc.).

The acid pickling treatment was carried out on the metal strip by soaking it into an acid pickling solution containing 100 g/L of sulfuric acid for 30 seconds in room temperature.

The Ni plating was carried out by passing electricity for 10 seconds through a plating liquid containing 400 g/L of nickel sulfamite, 30 g/L of nickel chloride and 30 g/L of boric acid, under the conditions of a liquid temperature of 55° C. and a current density of 0.1 to 10 A/dm2 as indicated in Table 1.

The insulating coating layer was formed by perpendicularly discharging varnish (fluid applied substance) on the surface of the running metal base material out of a rectangular discharging port of an applicator, and by pre-heating it for 1 minutes at 150° C. and then heating it for 5 minutes at 350° C. The varnish was produced so that a thickness of the resin was a range from 8 to 10 μm by using a polyimide (PI) solution using n-methyl 2-pyrolidone as solvent (manufactured by Arakawa Chemical Industries Ltd.).

(Evaluation Conditions)

The measurement of plating thickness and the analysis by Auger electron spectroscopy were carried out for a site of the obtained composite material for an electrical/electronic part, where the insulating film was not provided. Subsequently, the composite material for an electrical/electronic part thus obtained was subjected to an evaluation of the adhesiveness of plating and an evaluation of solderability.

It is noted that the measurement of the plating thickness was carried out in terms of an average value of ten samples by using an X-ray fluorescence thickness meter SFT-3200 (made by Seiko-Epson Precision Co.).

In the analysis by Auger electron spectroscopy, a quantitative analysis was carried out using Model 680 manufactured by Ulvac-Phi, Inc. at an accelerating voltage of 10 kV and a current value of 1 nA for an area having a size of 50 μm×50 μm.

In the evaluation of the adhesiveness of plating, the composite material for an electrical/electronic part thus obtained was punched into a specimen having a length of 30 mm, subsequently a site where the metal layer surface was exposed (indicated as "surface" in the following tables) and a punched cross-section freshly generated by punching processing (indicated as "cross-section" in the following tables) were subjected to electrolytic degreasing and acid pickling treatments in this sequence and then to Ni plating under the same conditions as those used in the sample production, and a tape peeling test was carried out based on JIS-H8504. The Ni plating was carried out using the same plating bath as that used in the sample production, by passing electricity for 2 minutes at a current density of 5 A/dm$^2$. For the metal layer surface, the tape peeling test was carried out after cross-cuts which measured 2 mm on each side were provided on the surface, while for the punched cross-section, the tape peeling test was carried out without treating the surface. The tape used in the test was 631S#25 manufactured by Teraoka Seisakusho Co., Ltd. The evaluation criteria were such that it was rated "○" when peeling of the plating did not occur, and "x" when peeling of the plating occurred.

The evaluation of solderability was carried out by punching the composite material for an electrical/electronic part thus obtained into a specimen having a length of 30 mm, subsequently immersing the specimen in a flux for 5 seconds, immersing the specimen for 10 seconds in a solder bath of Sn-3.0Ag-0.5Cu heated to 245° C., and then, for sites where the metal layer surface was exposed or a punched cross-section freshly generated by punching processing, observing the solidified solder under an optical microscope at a magnification of 60 times. For the flux, ULF-300R manufactured by Tamura Kaken Corp. was used. The evaluation criteria were such that it was rated "⊙" when the solder surface was smooth and the metal layer was completely covered; "○" when the metal layer was completely covered, but the surface unevenness at the solder surface was severe and solder defects represented by horns were recognized; and "x" when craters of solder were generated, and exposure of the metal layer was recognized.

(Evaluation Result)

The results of the measurement of plating thickness and the analysis by Auger electron spectroscopy are presented in Table 1. Furthermore, the results of the evaluation of the adhesiveness of plating and solderability are presented in Table 2. In Table 1, the current density of Ni plating used during the sample production is indicated as well.

TABLE 1

| | Ni Plating-polyimide | | | | | | | |
|---|---|---|---|---|---|---|---|---|
| | Sample | Current density | Plating thickness | Auger electron spectroscopy | | | | Cu/Ni |
| | No. | [A/dm$^2$] | [μm] | C | O | Ni | Cu | ratio |
| This invention | 1 | 0.1 | 0 | 43.17 | 24.27 | 18.23 | 14.33 | 0.786 |
| | 2 | 0.3 | 0 | 42.14 | 25.24 | 22.72 | 9.90 | 0.436 |
| | 3 | 0.5 | 0 | 37.98 | 29.68 | 25.48 | 6.86 | 0.269 |
| | 4 | 0.7 | 0.002 | 38.04 | 30.30 | 26.02 | 5.64 | 0.217 |

TABLE 1-continued

| | Ni Plating-polyimide | | | | | | | |
|---|---|---|---|---|---|---|---|---|
| | Sample | Current density | Plating thickness | Auger electron spectroscopy | | | | Cu/Ni |
| | No. | [A/dm$^2$] | [μm] | C | O | Ni | Cu | ratio |
| | 5 | 1 | 0.009 | 38.27 | 27.51 | 29.96 | 4.26 | 0.142 |
| | 6 | 3 | 0.046 | 45.71 | 26.86 | 26.09 | 1.34 | 0.051 |
| | 7 | 5 | 0.091 | 46.73 | 27.60 | 25.49 | 0.18 | 0.007 |
| Comparative | 8 | 7 | 0.124 | 44.12 | 27.85 | 28.03 | 0.00 | 0.000 |
| example | 9 | 10 | 0.212 | 46.09 | 27.74 | 26.17 | 0.00 | 0.000 |

TABLE 2

| | Ni Plating- polyimide | | | | | |
|---|---|---|---|---|---|---|
| | Sample | Cu/Ni | Adhesiveness of plating | | Solderability | |
| | No. | ratio | Surface | Cross-section | Surface | Cross-section |
| This | 1 | 0.786 | ○ | ○ | ○ | ⦿ |
| invention | 2 | 0.436 | ○ | ○ | ⦿ | ⦿ |
| | 3 | 0.269 | ○ | ○ | ⦿ | ⦿ |
| | 4 | 0.217 | ○ | ○ | ⦿ | ⦿ |
| | 5 | 0.142 | ○ | ○ | ⦿ | ⦿ |
| | 6 | 0.051 | ○ | ○ | ⦿ | ⦿ |
| | 7 | 0.007 | ○ | ○ | ○ | ⦿ |
| Comparative | 8 | 0.000 | x | x | x | x |
| example | 9 | 0.000 | x | x | x | x |

As shown in Table 1, it can be seen that in Comparative Example Nos. 8 and 9 where the plating thickness was thick, the exposure of Cu to the metal layer surface did not occur. In Example Nos. 1 to 3 where the plating thickness was thin, although the plating thickness could not be measured with fluorescent X-rays, it was confirmed from the results of the analysis by Auger electron spectroscopy that Ni plating had occurred. Here, the plating thickness being "0" means that the boundary between the metal base material and the metal plating layer has disappeared, and the metal base material and the metal plating layer have been integrated.

As shown in Table 2, in Comparative Example Nos. 8 and 9, since the exposure of Cu to the metal layer surface did not occur, the adhesiveness of plating to the metal layer and solderability were poor. On the other hand, in Example Nos. 1 to 7, the exposure of Cu occurred such that the Cu/Ni ratio at the metal layer surface was 0.005 or more, the adhesiveness of plating to the metal layer and solderability were excellent. Particularly, in Example Nos. 2 to 6 in which the Cu/Ni ratio was 0.05 to 0.5, solderability to the metal layer surface was particularly excellent. Example No. 1 in which the Cu/Ni ratio was 0.786, has resulted in slightly poor solderability, and it is thought to be because the corrosion resistance effect was not sufficiently exhibited due to the small amount of Ni, and oxidation of Cu had proceeded.

Example 2

Composite materials for an electrical/electronic part of this invention and comparative examples were produced in the same manner as in Example 1, except that the insulating coating layer was formed by heating a varnish of a solution of polyamide-imide (PAI) in n-methyl-2-pyrrolidone as a solvent, at 300° C. for 30 seconds (manufactured by Totoku Toryo Co., Ltd.), and the evaluation tests were carried out. The results are presented in Tables 3 and 4.

TABLE 3

| | Ni Plating-polyamide-imide | | | | | | | |
|---|---|---|---|---|---|---|---|---|
| | Sample | Current density | Plating thickness | Auger electron spectroscopy | | | | Cu/Ni |
| | No. | [A/dm$^2$] | [μm] | C | O | Ni | Cu | ratio |
| This | 10 | 0.1 | 0 | 40.84 | 25.40 | 26.96 | 6.80 | 0.252 |
| invention | 11 | 0.3 | 0 | 45.89 | 23.24 | 26.39 | 4.48 | 0.170 |
| | 12 | 0.5 | 0 | 45.49 | 24.63 | 26.66 | 3.22 | 0.121 |
| | 13 | 0.7 | 0.002 | 45.79 | 24.77 | 26.56 | 2.88 | 0.108 |
| | 14 | 1 | 0.009 | 46.25 | 24.76 | 27.91 | 1.08 | 0.039 |
| | 15 | 3 | 0.046 | 39.80 | 26.72 | 33.28 | 0.20 | 0.006 |
| Comparative | 16 | 5 | 0.091 | 37.03 | 24.86 | 38.11 | 0.00 | 0.000 |
| example | 17 | 7 | 0.124 | 43.18 | 23.32 | 33.50 | 0.00 | 0.000 |
| | 18 | 10 | 0.212 | 39.78 | 25.19 | 35.03 | 0.00 | 0.000 |

TABLE 4

| Ni Plating-polyamide-imide | | | | | | |
|---|---|---|---|---|---|---|
| | Sample | Cu/Ni | Adhesiveness of plating | | Solderability | |
| | No. | ratio | Surface | Cross-section | Surface | Cross-section |
| This invention | 10 | 0.252 | ○ | ○ | ◉ | ◉ |
| | 11 | 0.170 | ○ | ○ | ◉ | ◉ |
| | 12 | 0.121 | ○ | ○ | ◉ | ◉ |
| | 13 | 0.108 | ○ | ○ | ◉ | ◉ |
| | 14 | 0.039 | ○ | ○ | ◉ | ◉ |
| | 15 | 0.006 | ○ | ○ | ○ | ◉ |
| Comparative example | 16 | 0.000 | x | x | x | x |
| | 17 | 0.000 | x | x | x | x |
| | 18 | 0.000 | x | x | x | x |

As shown in Table 3, it can be seen that in Comparative Example Nos. 16 to 18 where the plating thickness was thick, the exposure of Cu to the metal layer surface did not occur. In Example Nos. 10 to 12 where the plating thickness was thin, although the plating thickness could not be measured with fluorescent X-rays, it was confirmed from the results of the analysis by Auger electron spectroscopy that Ni plating had occurred. For the reason why the amount of exposure of Cu to the metal layer surface was smaller even though the plating thickness was the same as the thickness of Example 1, it is thought to be due to the difference in the heat treatment history used when the insulating coating layer was formed.

As shown in Table 4, in Comparative Example Nos. 16 to 18, since the exposure of Cu to the metal layer surface did not occur, the adhesiveness of plating to the metal layer and solderability were poor. On the other hand, in Example Nos. 10 to 15, the exposure of Cu occurred such that the Cu/Ni ratio at the metal layer surface was 0.005 or more, the adhesiveness of plating to the metal layer and solderability were excellent. Particularly, in Example Nos. 10 to 14 in which the Cu/Ni ratio was 0.03 or more, solderability to the metal layer surface was particularly excellent.

Example 3

Composite materials for an electrical/electronic part of this invention and comparative examples were produced in the same manner as in Example 2, except that the metal strip provided with Ni plating was subjected to a heat treatment at 250° C. for one hour before the insulation coating layer was provided thereon, and the evaluation tests were carried out. The results are presented in Tables 5 and 6.

TABLE 5

| Ni Plating-polyamide-imide | | | | | | | | |
|---|---|---|---|---|---|---|---|---|
| | Sample | Current density | Plating thickness | Auger electron spectroscopy | | | | Cu/Ni |
| | No. | [A/dm$^2$] | [μm] | C | O | Ni | Cu | ratio |
| This invention | 19 | 0.1 | 0 | 41.33 | 25.18 | 16.87 | 16.62 | 0.985 |
| | 20 | 0.3 | 0 | 41.38 | 25.61 | 21.47 | 11.54 | 0.537 |
| | 21 | 0.5 | 0 | 40.81 | 25.48 | 22.73 | 10.98 | 0.483 |
| | 22 | 0.7 | 0.002 | 40.31 | 26.59 | 25.16 | 7.94 | 0.316 |
| | 23 | 1 | 0.009 | 41.37 | 26.54 | 26.17 | 5.92 | 0.226 |
| | 24 | 3 | 0.046 | 42.58 | 28.46 | 25.26 | 3.70 | 0.146 |
| | 25 | 5 | 0.091 | 45.53 | 25.98 | 27.34 | 1.15 | 0.042 |
| | 26 | 7 | 0.124 | 44.32 | 27.65 | 27.81 | 0.22 | 0.008 |
| Comparative example | 27 | 10 | 0.212 | 45.58 | 26.53 | 27.89 | 0.00 | 0.000 |

TABLE 6

| Ni Plating-polyamide-imide | | | | | | |
|---|---|---|---|---|---|---|
| | Sample | Cu/Ni | Adhesiveness of plating | | Solderability | |
| | No. | ratio | Surface | Cross-section | Surface | Cross-section |
| This invention | 19 | 0.985 | ○ | ○ | ○ | ◉ |
| | 20 | 0.537 | ○ | ○ | ◉ | ◉ |
| | 21 | 0.483 | ○ | ○ | ◉ | ◉ |
| | 22 | 0.316 | ○ | ○ | ◉ | ◉ |
| | 23 | 0.226 | ○ | ○ | ◉ | ◉ |
| | 24 | 0.146 | ○ | ○ | ◉ | ◉ |
| | 25 | 0.042 | ○ | ○ | ◉ | ◉ |
| | 26 | 0.008 | ○ | ○ | ○ | ◉ |
| Comparative example | 27 | 0.000 | x | x | x | x |

As shown in Table 5, it can be seen that in Comparative Example No. 27 where the plating thickness was thick, the exposure of Cu to the metal layer surface did not occur. In Example Nos. 19 to 21 where the plating thickness was thin, although the plating thickness could not be measured with fluorescent X-rays, it was confirmed from the results of the analysis by Auger electron spectroscopy that Ni plating had occurred. In the samples of this invention, since a heat treatment was carried out before the insulation coating layer was provided, the amount of exposure of Cu to the metal layer surface was larger even though the plating thickness was the same as that used in Example 2.

The Ni-30% Zn alloy plating was carried out in a plating solution containing 75 g/L of nickel chloride, 30 g/L of zinc chloride, 30 g/L of ammonium chloride and 15 g/L of sodium thiocyanate, under the conditions of a liquid temperature of 25° C. and a current density of 0.05 to 0.5 A/dm$^2$.

The Ni—Fe alloy plating was carried out in a plating solution containing 250 g/L of nickel sulfate, 50 g/L of iron sulfate and 40 g/L of boric acid, under the conditions of a liquid temperature of 50° C. and a current density of 1 to 10 A/dm$^2$.

The evaluation results for the adhesiveness of plating and solderability of the materials thus obtained are presented in Table 7.

TABLE 7

| | Sample No. | Kind of insulating layer | Kind of metal layer | Current density [A/dm$^2$] | Cu/Ni ratio | Adhesiveness of plating | | Solderability | |
|---|---|---|---|---|---|---|---|---|---|
| | | | | | | Surface | Cross-section | Surface | Cross-section |
| This invention | 28 | PI | Ni—10% Zn | 0.5 | 0.124 | ○ | ○ | ◉ | ◉ |
| | 29 | | | 1 | 0.041 | ○ | ○ | ◉ | ◉ |
| | 30 | | | 3 | 0.006 | ○ | ○ | ○ | ◉ |
| | 31 | | Ni—30% Zn | 0.05 | 0.113 | ○ | ○ | ◉ | ◉ |
| | 32 | | | 0.1 | 0.035 | ○ | ○ | ◉ | ◉ |
| | 33 | | | 0.3 | 0.005 | ○ | ○ | ○ | ◉ |
| | 34 | | Ni—Fe | 1 | 0.138 | ○ | ○ | ◉ | ◉ |
| | 35 | | | 3 | 0.036 | ○ | ○ | ◉ | ◉ |
| | 36 | | | 5 | 0.007 | ○ | ○ | ○ | ◉ |
| | 37 | PAI | Ni—10% Zn | 0.5 | 0.039 | ○ | ○ | ◉ | ◉ |
| | 38 | | | 3 | 0.007 | ○ | ○ | ○ | ◉ |
| | 39 | | Ni—30% Zn | 0.05 | 0.040 | ○ | ○ | ◉ | ◉ |
| | 40 | | | 0.3 | 0.006 | ○ | ○ | ○ | ◉ |
| | 41 | | Ni—Fe | 1 | 0.046 | ○ | ○ | ◉ | ◉ |
| | 42 | | | 5 | 0.008 | ○ | ○ | ○ | ◉ |
| Comparative example | 43 | PI | Ni—10% Zn | 5 | 0.000 | x | x | x | x |
| | 44 | | Ni—30% Zn | 0.5 | 0.000 | x | x | x | x |
| | 45 | | Ni—Fe | 10 | 0.000 | x | x | x | x |
| | 46 | PAI | Ni—10% Zn | 4 | 0.000 | x | x | x | x |
| | 47 | | | 5 | 0.000 | x | x | x | x |
| | 48 | | Ni—30% Zn | 0.4 | 0.000 | x | x | x | x |
| | 49 | | | 0.5 | 0.000 | x | x | x | x |
| | 50 | | Ni—Fe | 7 | 0.000 | x | x | x | x |
| | 51 | | | 10 | 0.000 | x | x | x | x |

As shown in Table 6, in Comparative Example No. 27, since the exposure of Cu to the metal layer surface did not occur, the adhesiveness of plating to the metal layer and solderability were poor. On the other hand, in Example Nos. 19 to 26, the exposure of Cu occurred such that the Cu/Ni ratio at the metal layer surface was 0.005 or more, the adhesiveness of plating to the metal layer and solderability were excellent. Particularly, in Example Nos. 20 to 25 in which the Cu/Ni ratio was 0.04 to 0.6, solderability to the metal layer surface was particularly excellent. Example No. 19 in which the Cu/Ni ratio was 0.985, has resulted in slightly poor solder ability, and it is thought to be because the corrosion resistance effect was not sufficiently exhibited due to the small amount of Ni, and oxidation of Cu had proceeded.

Example 4

Composite materials for an electrical/electronic part of this invention and comparative examples were produced in the same manner as in Example 1 and Example 2, except that Ni-10% Zn plating, Ni-30% Zn plating or Ni—Fe plating were carried out instead of Ni plating.

The Ni-10% Zn alloy plating was carried out in a plating solution containing 5 g/L of nickel sulfate, 1 g/L of zinc pyrrolate and 100 g/L of potassium pyrrolate, under the conditions of a liquid temperature of 40° C. and a current density of 0.5 to 5 A/dm$^2$.

As shown in Table 7, in Comparative Example Nos. 43 to 51, since the exposure of Cu to the metal layer surface did not occur, the adhesiveness of plating to the metal layer and solderability were poor. On the other hand, in Example Nos. 28 to 42, the exposure of Cu occurred such that the Cu/Ni ratio at the metal layer surface was 0.005 or more, the adhesiveness of plating to the metal layer and solderability are excellent. Particularly, in Example Nos. 28, 29, 31, 32, 34, 35, 37, 39 and 41 in which the Cu/Ni ratio was 0.03 or more, solderability to the metal layer surface was particularly excellent. From these results, it is understood that the present invention is effective even in the case where the metal layer is formed of a Ni alloy.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-164850 filed in Japan on Jun. 24, 2008, which is entirely herein incorporated by reference.

The invention claimed is:

1. A composite material for an electrical/electronic part, which is used as a material for use in an electrical/electronic part, comprising:

a metal base material having at least a surface formed of Cu or a Cu alloy; and an insulating film provided on at least a part of the metal base material;

wherein a metal layer having Cu diffused in Ni or a Ni alloy is interposed between the metal base material and the insulating film, wherein the metal layer is subjected to a heat treatment at 150° C. to 400° C. for 5 to 30 seconds;

wherein the ratio of the number of Cu atoms to the number of Ni atoms (Cu/Ni) obtained by analyzing an outermost surface of the metal layer by Auger electron spectroscopy is from 0.005 to 0.483;

wherein the metal layer has a thickness of 0.001 to 0.05 μm; and wherein the insulating film is composed of a polyamide-imide.

2. The composite material for an electrical/electronic part according to claim 1, wherein the metal layer is a layer having Cu thermally diffused at a surface.

3. An electrical/electronic part, comprising the composite material for an electrical/electronic part according to claim 1, which is formed by subjecting at least a part of the metal layer to a plating treatment.

4. An electrical/electronic part, comprising the composite material for an electrical/electronic part according to claim 1, which is formed by subjecting at least a part of the metal layer to a soldering treatment.

5. A method of producing a composite material for an electrical/electronic part, comprising the steps of:

forming an insulating film on a metal base material having at least a surface formed of Cu or a Cu alloy, through a metal layer formed of Ni or a Ni alloy at least partially interposed between the metal base material and the insulating film;

performing a heat treatment at 150° C. to 400° C. for 5 to 30 seconds, before or after forming the insulating film to thermally diffuse Cu at the surface of the metal layer, thereby adjusting the ratio of the number of Cu atoms to the number of Ni atoms (Cu/Ni) obtained by analyzing an outermost surface of the metal layer by Auger electron spectroscopy to 0.005 to 0.483, wherein the metal layer has a thickness of 0.001 to 0.05 μm, and wherein the insulating film is composed of a polyamide-imide.

* * * * *